US006035755A

United States Patent [19]

Mori

[11] Patent Number: 6,035,755

[45] Date of Patent: Mar. 14, 2000

[54] PAPER CUTTER

[75] Inventor: Chuzo Mori, Katsushika-ku, Japan

[73] Assignee: Carl Manufacturing Co., Ltd., Tokyo, Japan

[21] Appl. No.: 09/111,478

[22] Filed: Jul. 8, 1998

[30] Foreign Application Priority Data

Jul. 15, 1997 [JP] Japan ..... 9-189924

[51] Int. Cl.[7] ..... B26D 1/18

[52] U.S. Cl. ..... 83/485; 83/455; 83/588; 83/614

[58] Field of Search ..... 83/461, 614, 56, 83/455, 582, 588, 485

[56] References Cited

U.S. PATENT DOCUMENTS

| | | | |
|---|---|---|---|
| 802,720 | 10/1905 | Weber | 83/485 X |
| 802,721 | 10/1905 | Weber | 83/485 X |
| 804,520 | 11/1905 | Colthar | 83/485 X |
| 1,434,475 | 11/1922 | Austin | 83/485 X |
| 3,628,412 | 12/1971 | Rogers, Jr. | 83/455 |
| 5,069,097 | 12/1991 | Mori | 83/455 X |
| 5,287,783 | 2/1994 | Mori | 83/614 X |
| 5,303,626 | 4/1994 | Uehara et al. | 83/620 X |
| 5,322,001 | 6/1994 | Boda | 83/455 X |
| 5,524,515 | 6/1996 | Boda | 83/455 |

FOREIGN PATENT DOCUMENTS 8-299891 9/1996 Japan .

*Primary Examiner*—M. Rachuba
*Assistant Examiner*—Dominic J Troiano
*Attorney, Agent, or Firm*—Oliff & Berridge, PLC

[57] ABSTRACT

A slider includes a rotary blade holding case and a guide member. A rotary blade bearing portion is provided on the rotary blade holding case. A shaft extends through a rotary blade while being clamped with a bearing member and a safety plate. After the shaft is coupled with the bearing portion, the guide member is coupled with the rotary blade holding case. Thereby, parts other than the shaft are adapted to be molded with a single material so as to reduce the manufacturing processes of the slider and the cost thereof. In addition, the rotary blade and the safety plate are mounted on the slider. If the slider is removed from the guide rail in the state where the rotary blade is in a unit with the slider, fingers are prevented from contacting the rotary blade, and the rotary blade can be easily replaced together with the slider.

4 Claims, 12 Drawing Sheets

PAPER CUTTER

BACKGROUND OF THE INVENTION

1. Field of the Invention

This patent relates to an improvement of a paper cutter.

2. Description of the Prior Art

Now, a conventional example of the paper cutter will be explained based on FIG. 20, in which a rail 3 is provided rotatably on a holding portion 2 of one end of the base 1, and on this rail 3 a slider 5 is applied. Further, the slider 5 is set not-separably from the rail 3 and both ends of the rail 3 are provided with stoppers. And, when paper cutting, the papers to be cut are put on the base 1, the rail 3 is inclined, an engaging pawl 6 mounted at the tip end of the rail 3 is hooked at the engaged portion 7 and the paper is fixed on the base by being clamped between the holding plate 4 on the below surface of the rail 3 and the upper surface of the base 1. And, by displacing the slider 5 laterally along the rail 3, a rotary blade applied to the slider 5 cuts the papers while rolling on the papers.

Further, the slider 5 is adapted to be provided in such a manner, as shown in FIG. 18, as the surface of the holder plate 504 is tightly in contact with the sliding surface 501 of the rotary blade 8 by inserting screw bars in through holes 504 pierced on the holder plate 505 while picking the knob 506 and fixing nuts 507 on the screw bars 503 projected from the through holes 505.

Further, in the patent laid-open publication No. Hei 8-229891, a rotary blade holder for preventing hands from touching directly the blade when replacing the rotary blade 8 is disclosed. Such situation is explained referring to FIG. 19, in the state where a cover 14 is opened the rotary blade 8 is inserted into a gap 15 with its one portion and held and fixed in the rotary blade holding surface 16, so that it is positioned within a U-letter recess portion 18 with its hexagonal hole 17 pierced at the center of the rotary blade 8. And, while a hexagonal shaft provided on the holder plate 504 shown in FIG. 18 is adapted to be coupled with the hexagonal hole 17 provided on the rotary blade 8, the rotary blade 8 is attracted to a magnet provided on the holder plate 504 due to pushing the holder plate 504 to the rotary blade 8.

Thus, by lifting up the rotary blade 8 until one portion of the rotary blade 8 is removed from the gap 15 while the rotary blade 8 being attracted to the holder plate 504 and picking up the knob 506, without touching the rotary blade 8 and while a new rotary blade being kept in the holder plate 504, the rotary blade 8 is adapted to be taken out from a holder body 9. And, as in FIG. 18, by mounting the holder plate 504 attracting the rotary blade 8 on the slider 5, the rotary blade 8 is adapted to be mounted on the slider 5 without touching the rotary blade 8.

Next, in a case where an old rotary blade 8 is accommodated in a holder 9, in FIG. 18, by removing the holder plate 504 due to picking up the knob 506 of the holder plate 504, the rotary blade 8 is removed from the slider 5 while being attracted by the magnet provided on the holder plate 504 and by picking up the knob 506 while attracting the rotary blade 8 to the holder plate 504 and inserting a portion of the rotary blade 8 in the gap 15 along the U-letter recessed portion 18, the rotary blade 8 is adapted to be accommodated in the holder 9.

In prior art shown in FIG. 17, a rail 10 is mounted on a normal paper support 109, which is formed substantially in a unit, and with this rail 10 is a slider 11 coupled. And this coupling of the slider 11 is carried out by engaging with T-letter of the rail 10 in section and on both side of the rail 10 stoppers 101 and 102 are provided to prevent the slider 11 from being removed from the rail 10. And, when cutting papers, by holding and fixing the papers to be set on a cutter sheet with the paper support 9 tightly with the left hand, it is carried out by making a cutter projected from a cutter blade (not rotary blade) from a cutter case 13 and displacing a cutter case 13 and displacing the slider 11. Further, the cutter blade is sunk in the cutter case 13 by releasing the holding of the projection 12 to avoid the hands from touching the cutter blade directly.

In any type of paper cutter mentioned above, since the slider is adapted not to be separated from the rail, the following problems to be improved are mentioned.

In the conventional art disclosed in FIG. 20, when replacing the rotary blade, since a new rotary blade accommodated in a holder is to be taken out in the state where the rotary blade is attracted to the holder plate 504 and this holder plate is to be mounted on the slider, the replacing process is difficult, and since a notice of taking care for avoiding the hands from being touched with the rotary blade, an improvement for handling such operation has to be carried out.

Further, since the slider 5 needs a lots of parts such as a holder plate 504 having a magnet, screw bar 503, nut 507 and a hexagonal shaft for pivoting the rotary blade 8, and since the magnet and the holder plate are different in material in addition they are not a single unit consisting of different materials, even though the holder plate body can be formed by a resin molding, the process of working the magnet and the one of connecting the magnet to the holder plate are separately carried out, and similarly even though the slider body can be formed by a resin molding, the screw bars are not single parts to be worked planted in separate processes, and that, since the hexagonal shaft has to be provided rotatably on the slider body, which cause the cutter to be highly costed to replace the rotary blade with the slider as a consuming part.

Further, in the prior art shown in FIG. 17, since the cutter blade itself can not be replaced and the slider can not remove from the rail, in the case where the cutter blade becomes dull, the paper cutter itself has to be abandoned.

Accordingly, the present invention is to provide a paper cutter in which, by forming the slider so as to make it as a single part consisting of a single material to become a low costed slider, and using a safety device to the slider itself, the slider is adapted to be replaceable together with the rotary blade to make it easy to replace the rotary blade and to enable to replace merely the slider made in a unit with the rotary blade, so that an economical loss can be minimized.

SUMMARY OF THE INVENTION

First feature of the present invention is characterized in that, in a paper cutter wherein a slider displaces along with a guide rail and paper cutting is carried out by rolling a rotary blade supported by the slider, the slider is divided into a rotary blade supporting case and a guide member, the rotary blade supporting case is provided with bearing portions for the rotary blade, shafts are inserted in the bearing portions so as to clamp the rotary blade between the bearing portions and a safety plate and a guide member is resiliently coupled with the rotary blade case.

Second feature of the present invention is characterized in that the above safety plate is formed in a disc, the radius of the half of which is larger than the radius of the rotary blade and the radius of the other half of which is smaller than the radius of the rotary blade.

Third feature of the present invention is characterized in that, the above safety plate is provided with a lever in a unitary manner.

According to the first feature of the present invention, by dividing the slider into the rotary blade holding case and the guide member, it is made easy to mold both in a resin molding, by providing the bearing portions on the rotary blade case to be inserted by the screw bars to clamp the rotary blade between the bearing portions and the safety plate, so that the rotary blade case, the guide member and the safety plate can be worked in molding using a single material and the rotary blade and the safety plate can be mounted on the rotary blade case. And, by coupling the guide member with the rotary blade case resiliently, an in and out volume of the rotary blade can be arranged when cutting is carried out.

According to the second feature of the present invention, due to the fact that the above safety plate of the first feature is formed as a disc and the radius of the half of the disc is made to be larger than the one of the rotary blade and another half of the disc is made to be smaller than the one of the rotary blade, by rotating the safety plate which is pivoted on the shaft for the rotary blade, projecting the half disc having the larger radius from the rotary blade case and hiding the rotary blade behind the safety plate, and by rotating the safety plate to reveal the another half of the disc having the radius smaller than the one of the rotary blade the cutter stands by for cutting.

According to the third feature of the present invention, by providing a lever on the safety plate in a unitary manner, when rotating the safety plate fingers are far from the rotary blade to avoid them from touching the blade.

DETAILED EXPLANATION OF THE INVENTION

Embodiment

Figure 1:
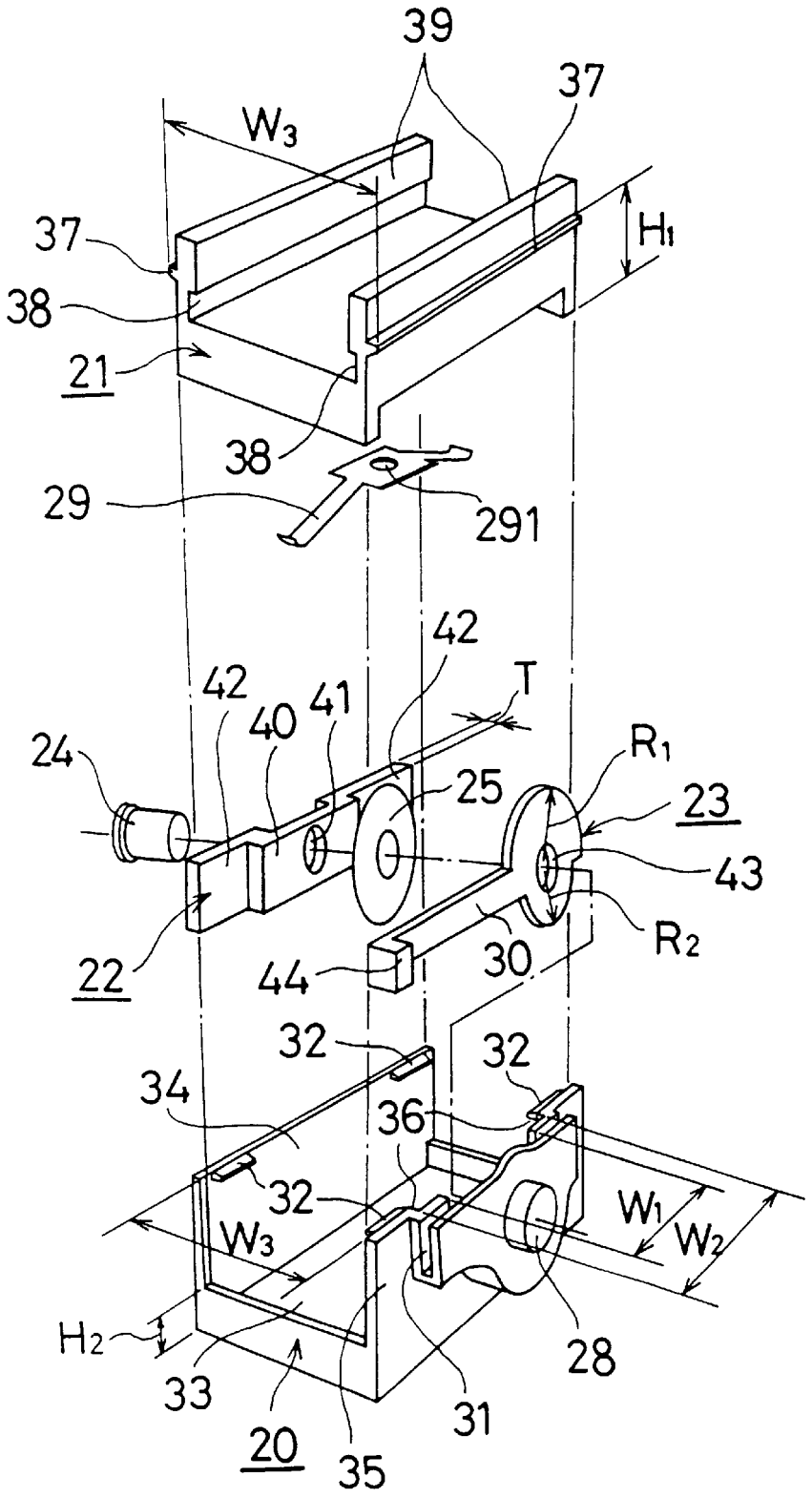
FIG. 1 is a broken and perspective view of one embodiment of the present invention.
Figure 2:
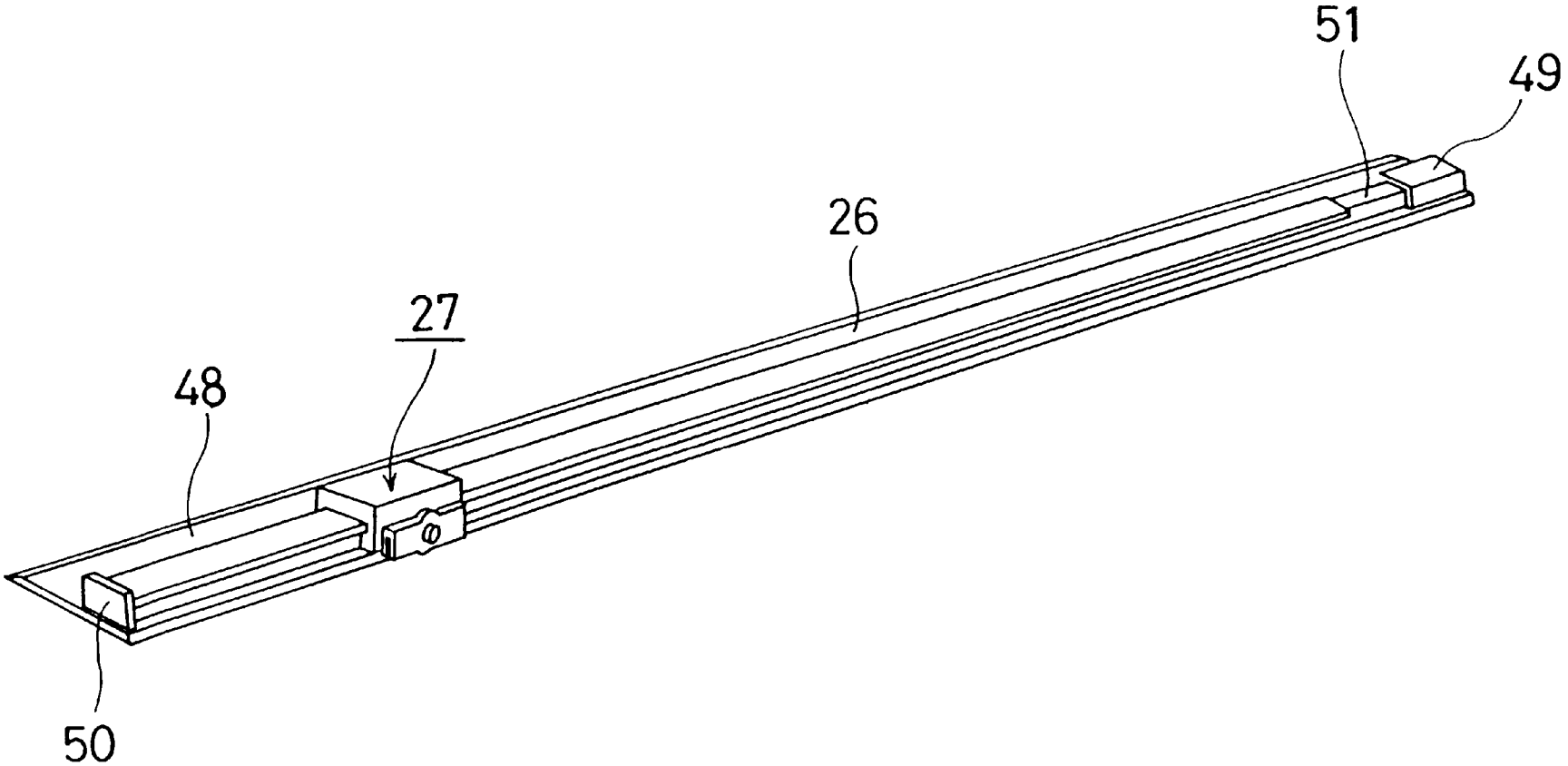
FIG. 2 is a perspective view using the slider in FIG. 1.

Referring to FIG. 1, first about a slider 27 based on FIG. 2, the slider is explained. The slider 27 is, as shown in FIG. 1. divided into a rotary blade holding case 20 and a guide member 21. The rotary blade holding case 20 is provided with a rotary blade bearing portion 28 and inside of which a slit 31 into which a safety plate 23 is inserted is provided.

Further, the rotary blade holding case 20 is formed in such a manner as two side walls 34 and 35 are provided and make openings having W3 width and two claws are provided on the inner top edges of the side walls 34 and 35 respectively. And, on the side wall 35 a stepped portion 36 having a width W2 and a cutout having a width W1, into which the safety plate 23 and the rotary blade 25 are inserted, and at the bottom 33 edges are two side panels having the height of $H_2$ are connected to both side walls 34 and 35 to form a box.

On both sides of the guide member 21, guide faces 39 and guide groove 38 are provided, and on opposite sides of the guide faces 39 hooks 37 which engage with the claws 32. The distance between two hooks 37 are adapted to be approximately same to the width W3 of the side walls 34 and 35 of the rotary blade holding case 20. And, in the state where the guide member 21 couples with the side walls 34 and 35 in such a manner as the guide member 21 widens both side walls 34 and 35 outwardly and the hooks 37 pass by the claws 32, the tip end of the hooks 37 slide on the insides of the side walls 34 and 35 and therefore the guide member 21 and the rotary blade holding case 20 are guided relatively in sliding. Further, thus by making the tip ends of the hooks slide on the side walls 34 and 35, the sliding area and resistance become small and the mutual movement between the guide member 21 and the rotary blade holding case is adapted to become smooth.

When the guide member 21 couples with the rotary blade holding case 20, a resin made spring member 29 is mounted on the bottom surface of the guide member 21. Due to the resilience of this spring member 29, in the state where the guide member 21 and the rotary blade holding case 20 are mutually displaced, the hooks 37 are engaged with the claws 32 and the mutual displacement between the guide member 21 and the rotary blade holding case 20 is restricted. In the state where the mutual displacement is thus restricted, the height $H_1$ from the upper side of the hooks 37 to the bottom surface of the guide member 21 is determined in such a manner as the bottom portion of the guide member 21 is not removed from the box formed at the bottom of the rotary blade holding case 20 having the height $H_2$ of the side panels. Thereby, the rotary blade holding case 20 and the guide member 21 are connected in a unitary manner without removing each other.

The thickness T of a bearing member 22 is approximately identical with the height of the stepped portion 36 in dimension, and in the state where the bearing member 22 is assembled to the stepped portion 36 and a flange portion 42 is tightly contacted, the bottom surface of the flange portion 42 is adapted to flash with the inner surface of the side wall 35 of the rotary blade holding case 20, and the bearing member 22 is adapted to be suppressed by the hooks 37 of the guide member 21 coupled with the rotary blade holding case 20. Or, at the time of assembling the flange portion 42, it may be adapted to be fixed to the side wall by adhesive. Further, on the bearing portion 22 a rotary blade contacting surface 40 is formed projectedly from the flange portions 42, on which a shaft hole 41 through which a shaft 24 is come is provided.

The safety plate 23 comprises a disc half of which is R1 and the other half of which is R2 in radius, the radius R1 is larger than the radius of the rotary blade 25 and the radius R2 is smaller than the rotary blade 25. Both of the half discs of the radius R1 and R2 forms a disc which is divided into two. At either half disc a lever 30 is located. And, at the tip end of the lever 30 a knob 44 is provided. At the centers of both discs having radius R1 and R2, a shaft hole 43 for the shaft 24 is pierced. The thickness of this safety plate 23 is adapted to be the one which allows it to be inserted in the slit 31 provided on the rotary blade 25 holding case 20.

Figure 18:
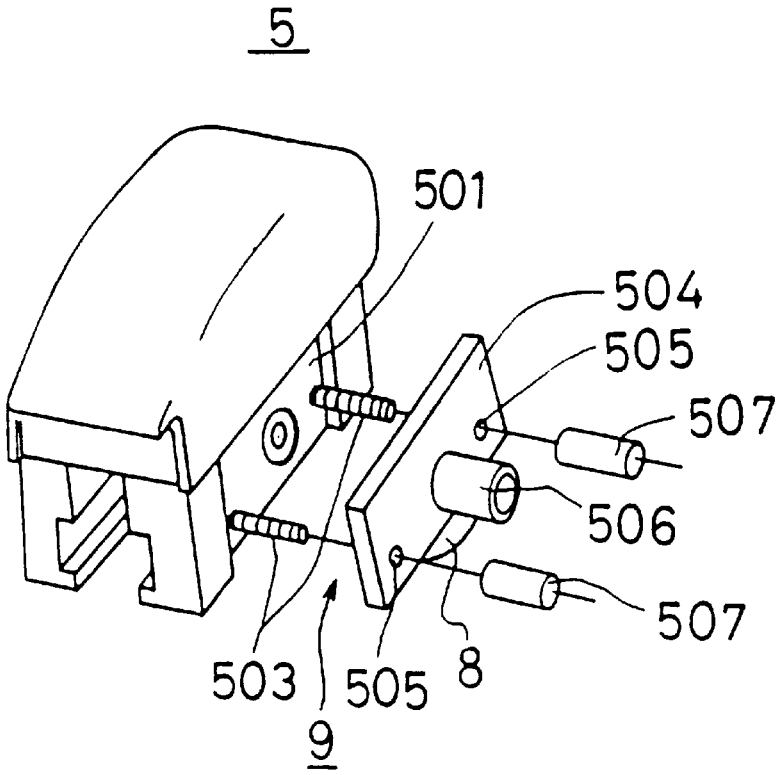
Fig.18 Prior Art
FIG. 18 is a perspective view of a conventional rotary blade holder.
Figure 19:
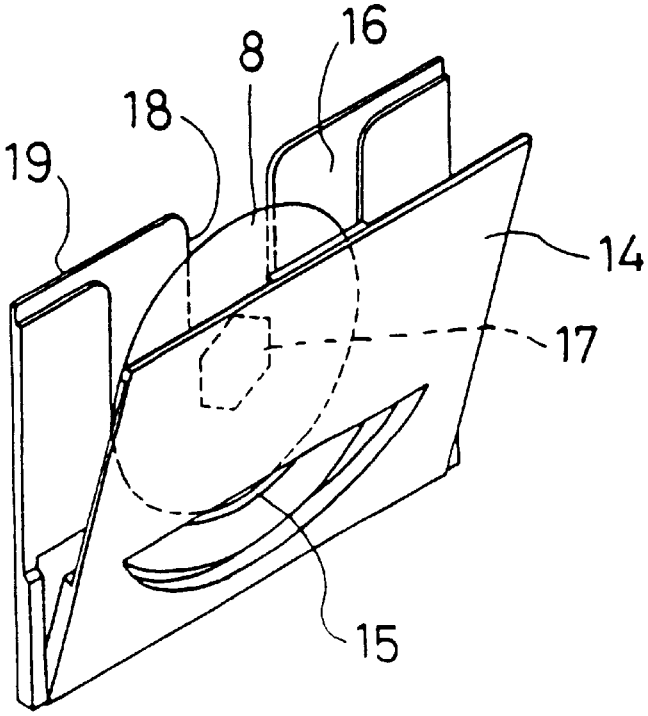
Fig.19 Prior Art
FIG. 19 is a perspective view of a conventional paper cutter.
Figure 20:
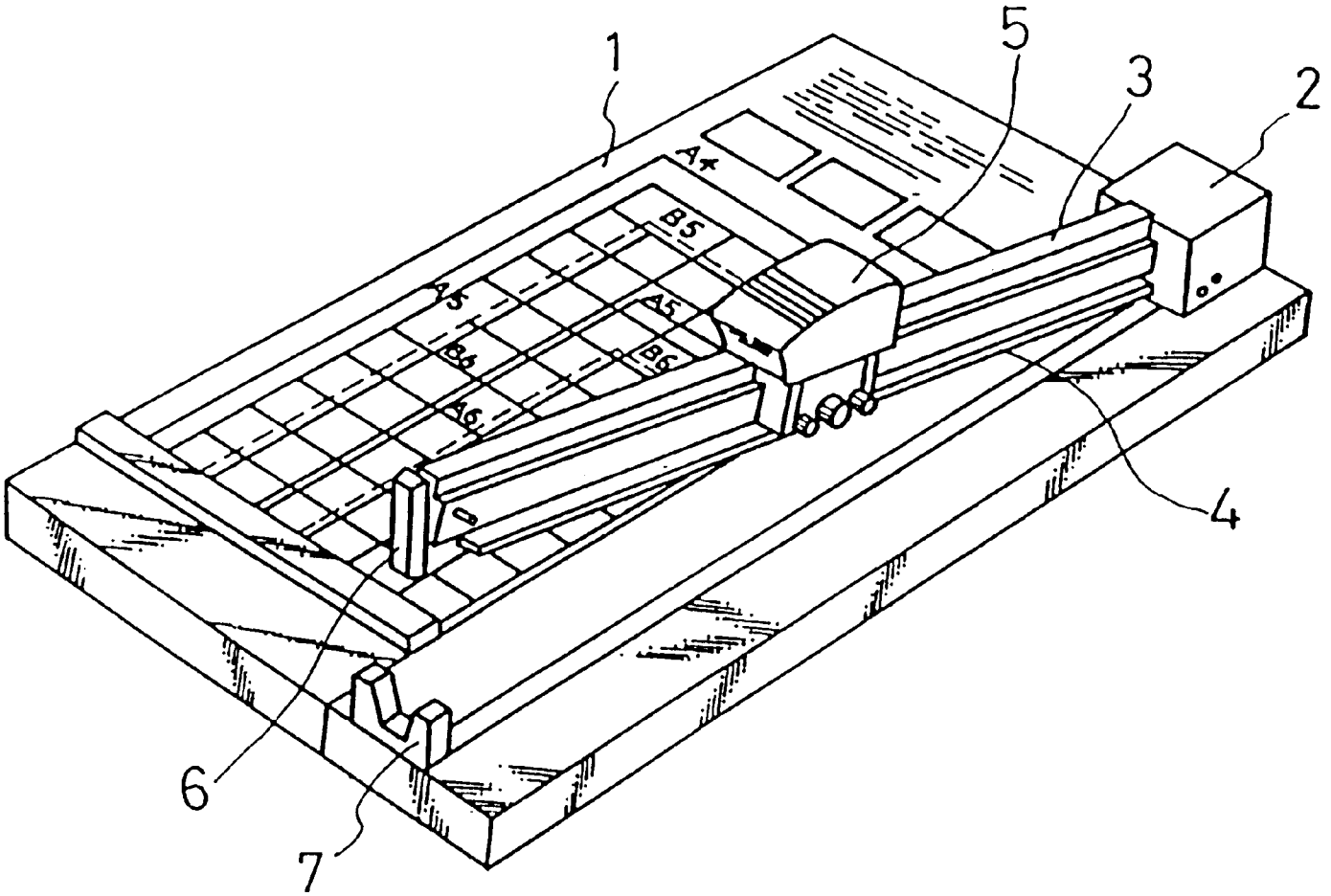
Fig.20 Prior Art
FIG. 20 is a perspective view of a conventional paper cutter.

Further, the rotary blade 25 comprises a round hole, not a hexagonal hole 17 as shown in FIGS. 18 and 19, and in the hexagonal case, the shaft rotates on the other hand, in the case of the round hole, to the fixed shaft the rotary blade 25 is adapted to rotate. Accordingly, for supporting the rotary blade 25 and the safety plate 23, without making the shaft 24 pressed in the rotary blade bearing portion 28 provided on the rotary blade holding case 20 and supporting both ends by the bearing member 22, the rotary blade 25 and the safety plate 23 are able to be fixed and supported on the rotary blade holding case 20 merely by the shaft 24. And, in the case where the shaft 24 is fixed and the rotary blade 25 is made to rotate, a rolling is generated on the rotary blade 25, which, however, is adapted to be reduced by clamping the rotary blade 25 between the rotary blade contacting surface 40 of the bearing member 22 and the safety plate 23.

Figure 3:
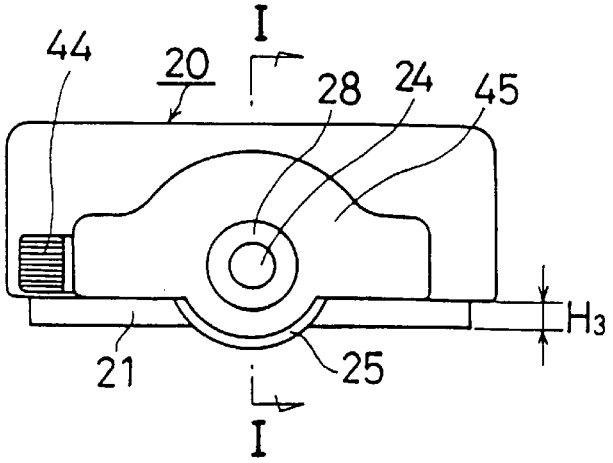
FIG. 3 is a front view of the slider of FIG. 1.
Figure 4:
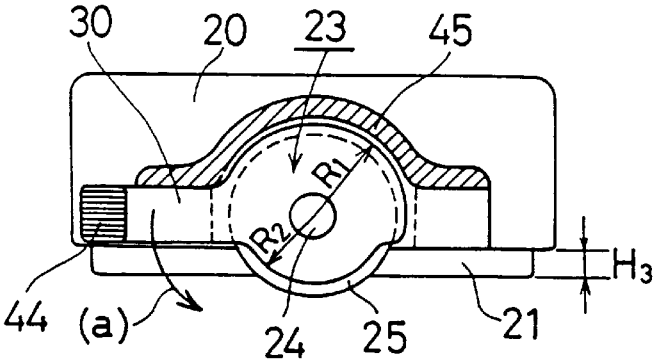
FIG. 4 is a partial sectional view showing the cover portion of FIG. 3.
Figure 6:
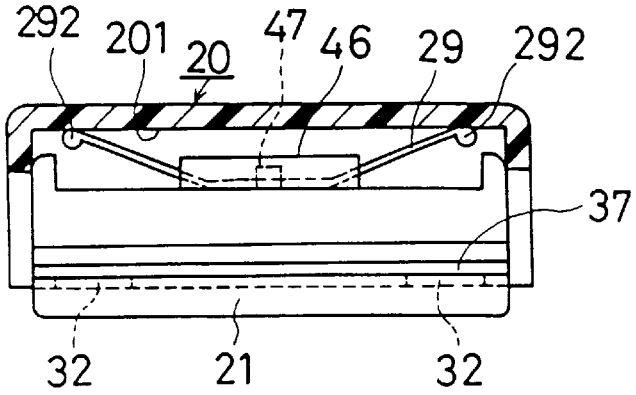
FIG. 6 is a vertically sectional view of the rotary blade support case along A—A line of FIG. 5.
Figure 7:
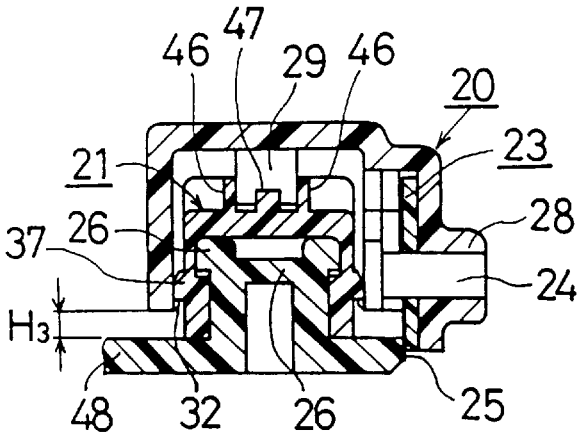
FIG. 7 is a vertically sectional view along B—B line in FIG. 3.

Next, using FIGS. 3–8, the assembled state of the present cutter will be explained. In FIGS. 3 and 4, a cover 45 is provided in such a manner as the safety plate 23 having a radius of R1 is able to be rotated. In the state where the claws 32 and the hooks 37 are engaged due to the resiliency of the spring member 29, the guide member 21 is projected by the height of $H_3$ from the rotary blade holding case 20. In the state where the guide member 21 is coupled with the guide rail 26, by pushing down the rotary blade holding case 20 within the range of the stroke of $H_3$, an in-out volume of the rotary blade 25 is adapted to be regulated, and as shown in FIG. 7 clearly, since the bottom end of the rotary blade holding case 20 abuts to a base 48 when it descends by the stroke $H_3$, the rotary blade 25 also does not descend any more. Thereby, the cutting-in volume of the rotary blade 25 is restricted to prevent the rotary blade 25 from being broken, and by making the cutting-in volume of the rotary blade 25 little, the life of a cutter shaft is adapted to be elongated.

Figure 5:
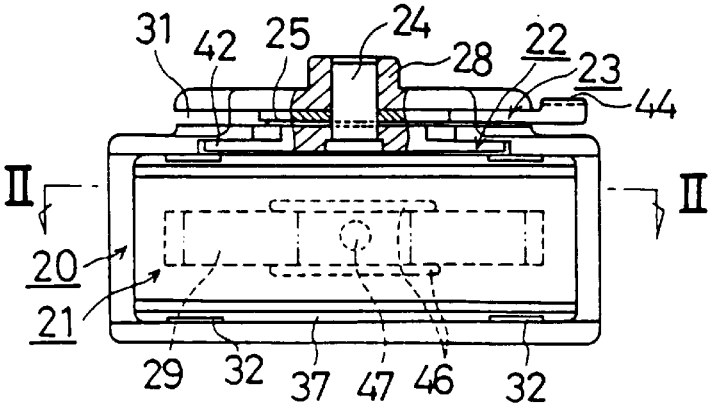
FIG. 5 is a bottom view of FIG. 3 partially in section.

In FIG. 5, in the state where the rotary blade 25 is clamped between the rotary blade contacting surface 40 of the bearing member 22 and the safety plate 23 inserted in the shaft hole of the bearing portion 28. Further, as shown in FIGS. 5–7, to the back surface of the guide member 21 a spring mounting portion 46 and a spring mounting projection 47 are formed in a unit by molding, the hole 191 of the spring member 20 shown in FIG. 1 is coupled with the spring mounting projection 47 and mounted between the spring mounting portion 46 to mount the spring member 29 on the guide member 21. Further, a sliding portion 292 is provided on the end of the spring member 29 to make the sliding effect good between the bottom surface 201 and the spring member 29.

Figure 8:
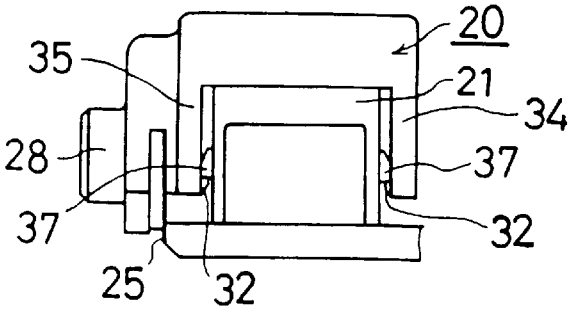
FIG. 8 is a right side view of the state where the slider is mounted on the guide rail in FIG. 3.

In FIG. 8, the claw 32 and the hook 37 are provided with an inclined surface respectively, when the guide member 21 is inserted in the rotary blade holding case 20 while pushing and widening the side walls 34 and 35, due to the mutual sliding between the claw 32 and the hook 37, the coupling operation of the guide member 21 in the rotary blade holding case 20 is adapted to be made easier.

Figure 9:
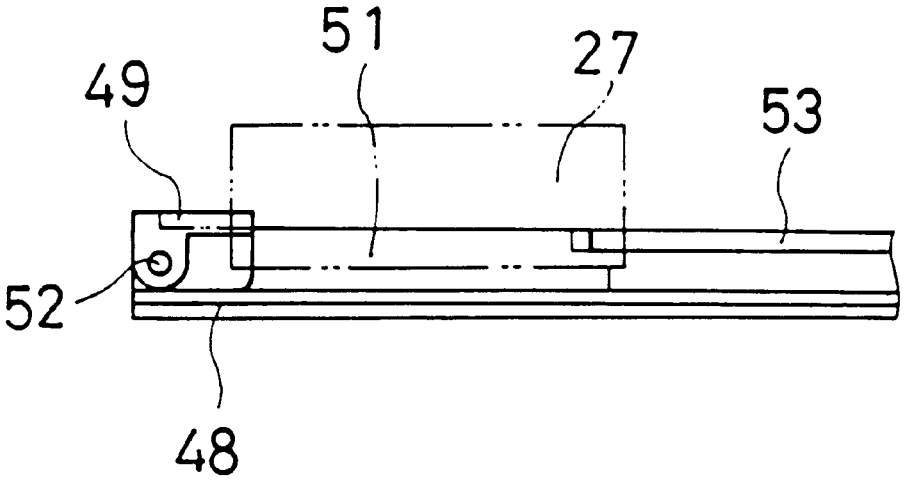
FIG. 9 is a partially enlarged view of the stopper portion in FIG. 2.
Figure 10:
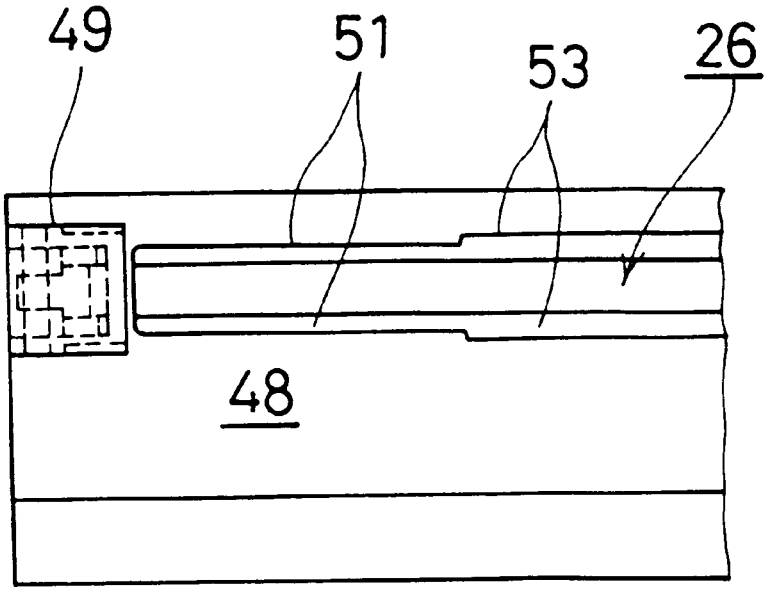
FIG. 10 is a plan view of FIG. 9.

As shown in FIG. 2, stoppers 49 and 50 are provided on both ends of the guide rail 26. Further, On one end of the guide rail 26 where the stopper 49 is located, a cut out portion 51 of the flange is provided. FIGS. 9 and 10 are an enlarged view of the stopper 49, which is mounted rotatably on the base 48 through a pin 52. And, at the end portion of the rail 26, the flange 53 is cut out to form a flange cut out portion 51, and by turning the stopper 49 and displacing the slider 27 to the flange cut out portion 51 the slider 27 can be removed from the rail 26.

Figure 11:
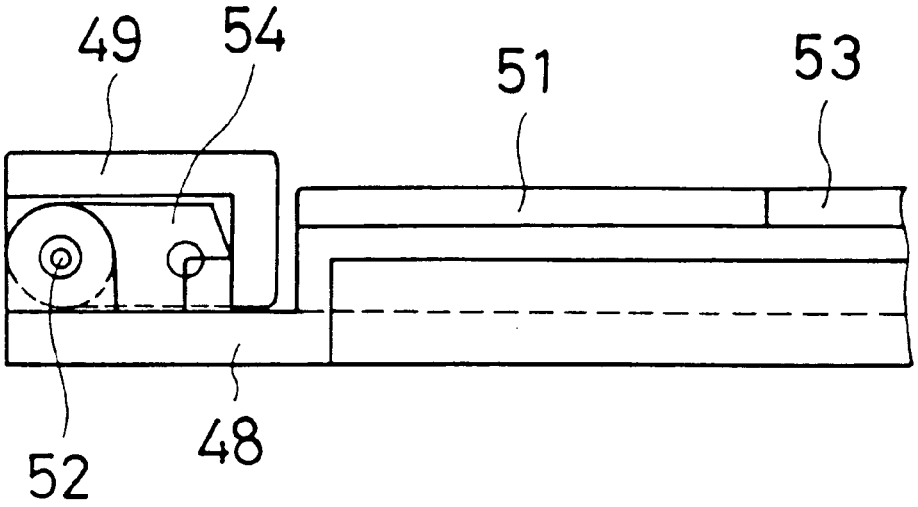
FIG. 11 is a front view of another embodiment of the stopper portion in FIG. 2.
Figure 12:
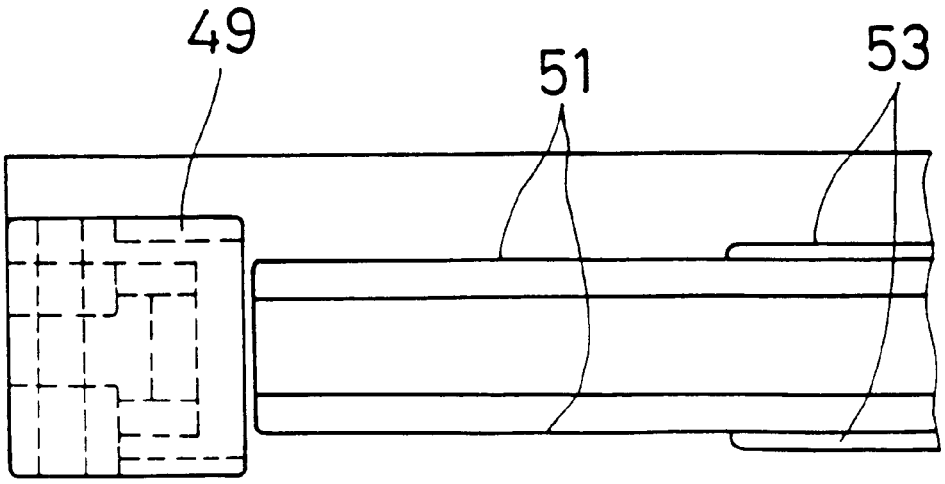
FIG. 12 is a plan view of FIG. 11.
Figure 13:
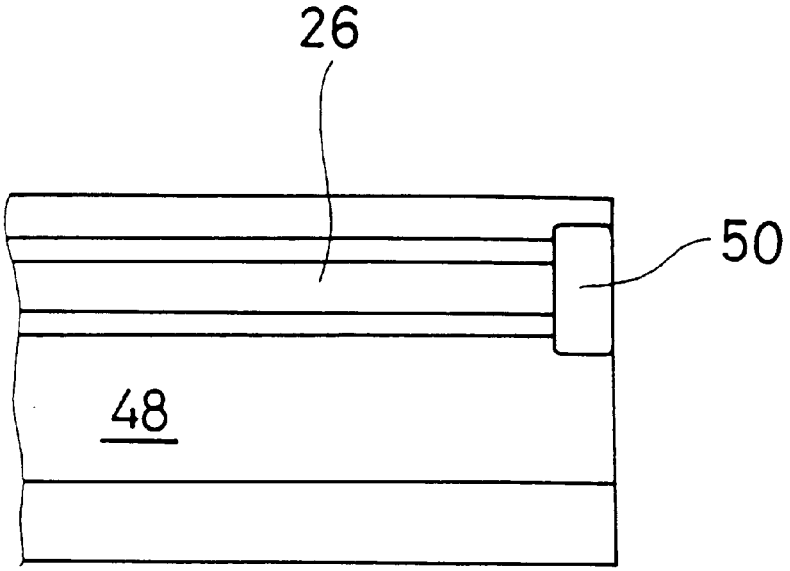
FIG. 13 is a plan view of the enlarged stopper portion in FIG. 2.
Figure 14:
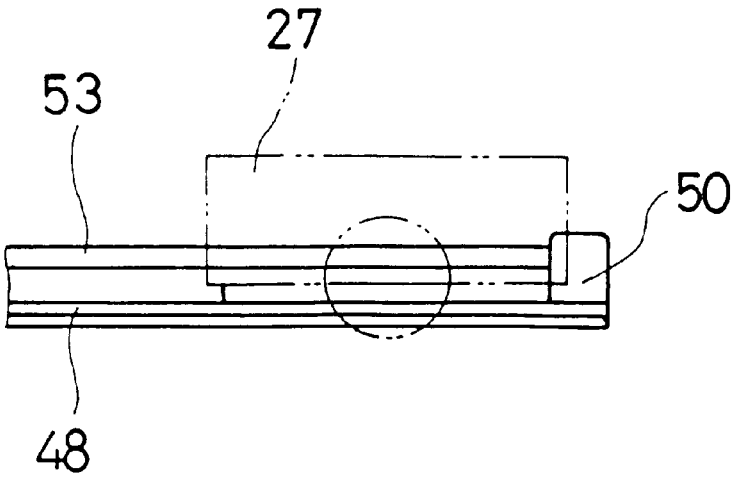
FIG. 14 is a front view of FIG. 13.

FIGS. 11 and 12 show another embodiment of the stopper 49, and when turning the stopper 49 in the state shown in figures, wherein a hook 54 is provided and the stopper 49 is prevented from being turned reversely. On other portions, they are identical with the ones shown in FIGS. 9 and 10, so that the explanation thereof is omitted. In FIGS. 13 and 14, the stopper 50 side is shown in an enlarged manner, in which the stopper 50 is fixed on the end of the guide rail 26. But, the flange cut out portion 51 which is formed by removing the flange portion 53 as in the case of the stopper 49 is not formed.

Figure 15:
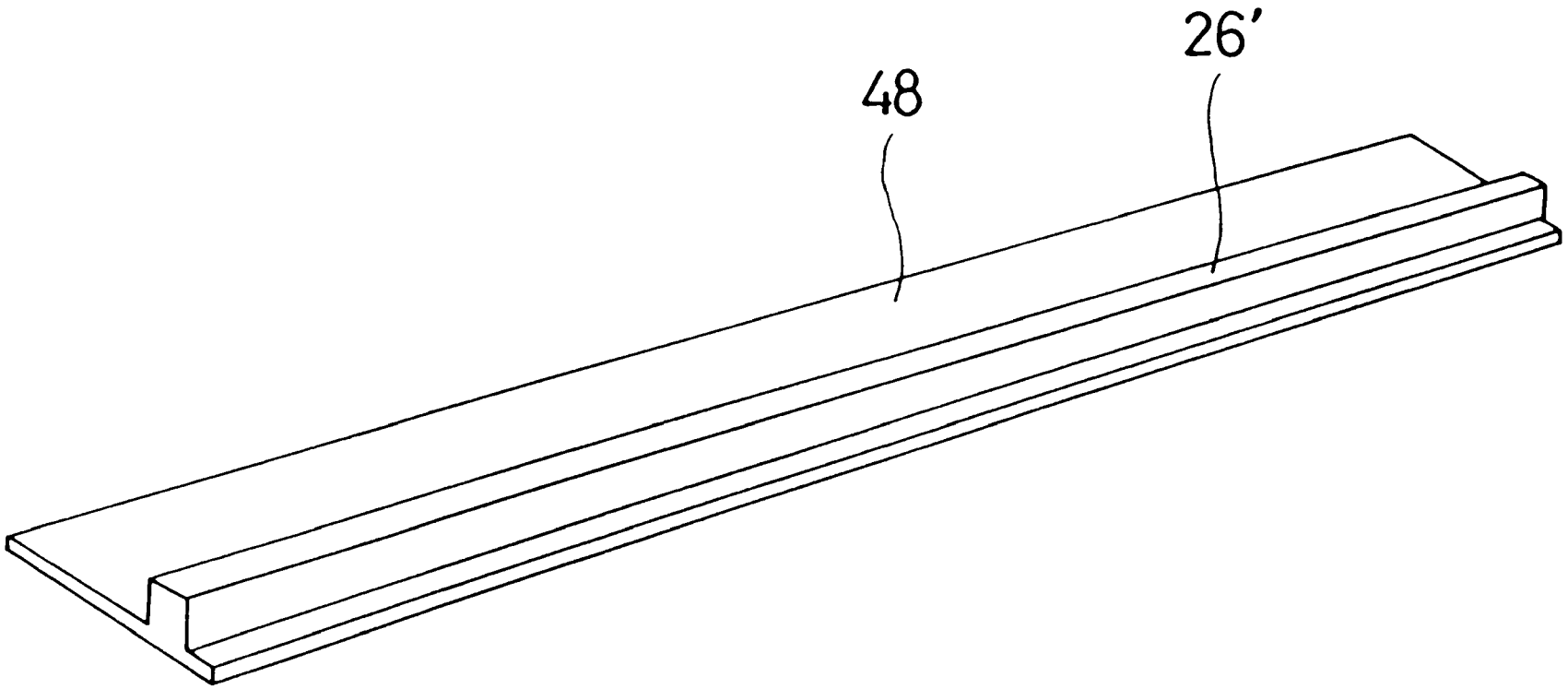
FIG. 15 is a perspective view of another embodiment of the guide rail.
Figure 16:
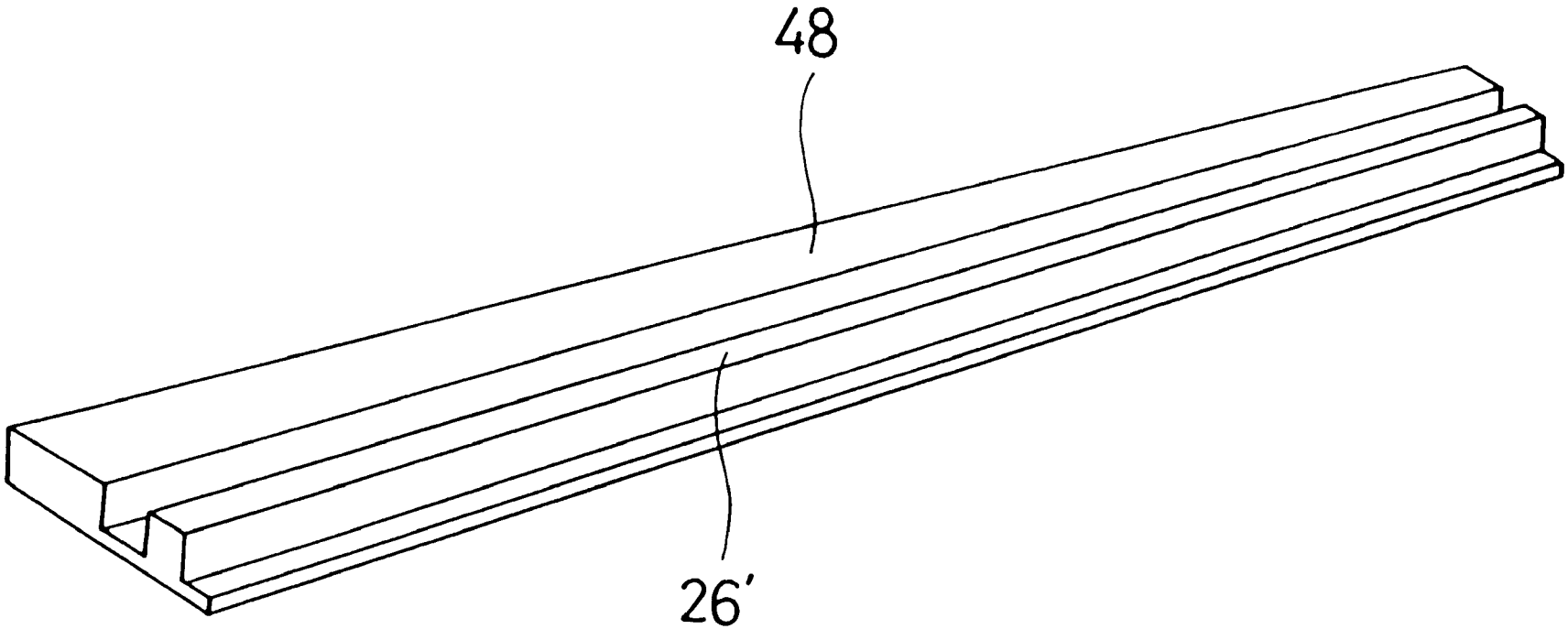
FIG. 16 is a perspective view of still another embodiment of the guide rail.
Figure 17:
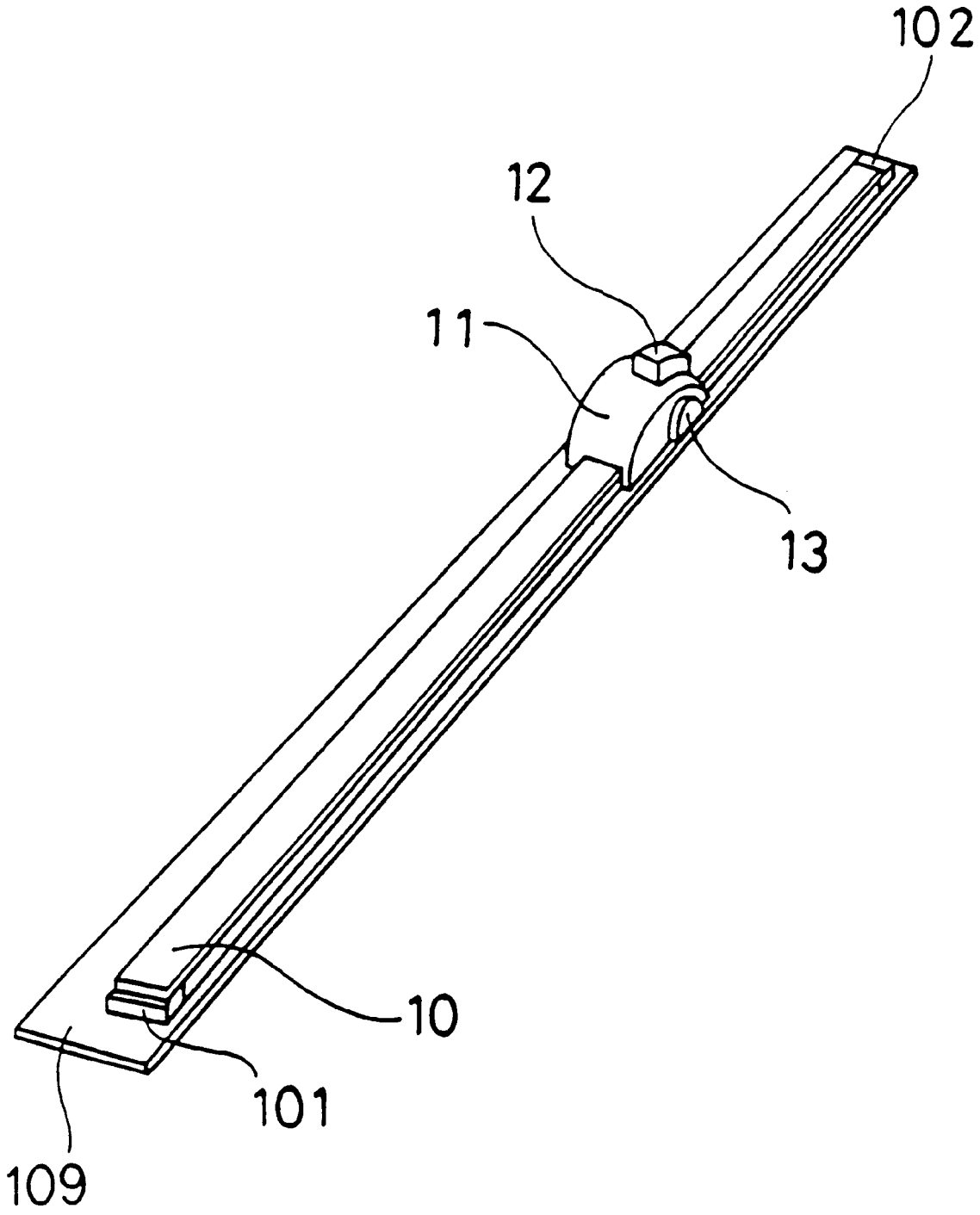
Fig.17 Prior Art
FIG. 17 is a perspective view of a conventional slider.

FIGS. 15 and 16 show the other embodiment of the guide rail 26, however, not like one as shown in FIG. 2, in which the sectional view of the guide rail 26' is T-letter shape, the sectional shape of the rail 26' is I-letter. In the case of the guide rail 26', the stoppers 49 and 50 as provided in FIG. 2 are not provided. Further, the guide groove 38 provided in the guide member 21 in FIG. 1 is not provided. And, the slider 27 shown in FIG. 2 is adapted to be removed at any position of the guide rail 26'.

Next, the operation of the present invention will be explained. In FIG. 1, the slider 27 (FIG. 2) is divided in two, i.e. the rotary blade holding case 20 and the guide member 21, so that, in the assembling of the rotary blade 25 the shaft 23 is inserted while clamping the rotary blade 25 between the bearing member 22 and the safety plate 23, such shaft 24 is made to press in the bearing portion 28 of the rotary blade holding case 20, and by coupling the guide member 21 with the rotary blade holding case 20 the rotary blade 25 can be mounted. Thus, since the slider 27 is formed by assembling each part, every part of the rotary blade holding case 20, the guide member 21, the bearing member 22 and the safety plate 23 can be molded using a single material. Further, the spring member 29 and the shaft 24 also can be molded a single material. In this case, the spring member 29 also may be manufactured by a resin molding, so that all parts other than the shaft 24 of metal material can be molded using one set of molds, i.e. a kit of molding can be carried out.

Further, since the safety plate 23 is formed disc-like and pivoted on the shaft 24, and the radius RI of the half of the disc is made to be larger than the one of the rotary blade 25 and the radius R2 of the other half of the disc is made to be smaller than the rotary blade 25, in the case where, as shown in FIG. 4, in the case where the half of the disc having radius R2 is not projected from the rotary blade holding case 20, as the rotary blade 25 is exposed and become able to cut papers, and in the case where by turning the safety plate 23 in the arrow (a), the half of the disc having the radius R1 is adapted to project from the rotary blade holding case 20, the rotary blade 25 is adapted to be hidden within the safety plate 23, so that, fingers do not touch the rotary blade 25.

Further, by providing a lever 30 on the safety plate 23, fingers are located far from the rotary blade 25, so that, since, for operation of the safety plate 23 it is sufficient for fingers to pick up the knob 44 provided on the tip end of the lever 30, fingers will never get in touch with the rotary blade 25.

Thus, since the safety plate 23 is provided on the slider itself, if the rotary blade 25 is formed with the slider in a unit and can not be removed from the slider 27 without getting in touch with the rotary blade 25, it can be replaced together with the slider 27.

As explained, according to the present invention, the slider to be displaced along the guide rail is divided into the rotary blade holding case and the guide member 21 enabling it easily to be molded using a resin, and, since, in the constitution in which the rotary blade bearing member portion is provided on the rotary blade holding case, a shaft is come through the bearing member, and rotary blade and the safety plate in such a manner as the rotary blade is clamped with the bearing member and the safety plate, the shaft is inserted in the rotary bearing portion provided on the rotary blade holding case, the rotary blade holding case, the guide member, the bearing member and the safety plate can be formed in single resin material, the number of the slider manufacturing processes can be reduced to attain the slider of low cost. And, by mounting the rotary blade and the safety plate on the rotary blade holding case, when removing the slider from the guide rail, since the rotary blade and the slider are formed in a unit, the replacement of the rotary blade can be carried out without touching the rotary blade. And, by coupling the guide member resiliently with the rotary blade, the in-out volume of the rotary blade at the time of cutting operation can be regulated and made easier.

Further, by making the safety plate a disc, the radius of one half of which is larger than the one of the rotary blade and the radius of the other half of which is smaller than the rotary blade and by projecting the half of the disc which has the larger radius from the rotary blade holding case by turning the safety plate, the rotary blade is hidden behind the radius-larger disc, or by turning the disc for exposing the rotary blade from the rotary blade holding case to stand by for paper cutting, and thus, by one simple operation of turning the safety plate this paper cutter can play two functions of safety and cutting. In addition, the rotary blade can be replaced together with the slider which is formed in a unit with the rotary blade.

Further, the lever of the safety plate which is formed in a unitary manner enables fingers to be separated from the rotary blade at the time of operation, thereby fingers will not get in touch with the rotary blade to enhance the safety when replacing the rotary blade.

What is claimed is:

1. A paper cutter for cutting paper, comprising:

a rotary blade;

a guide rail;

a slider slidable along the guide rail to enable the rotary blade to cut the paper, the slider including:

a guide member slidable along the guide rail;

a rotary blade holding case mountable on the guide member in such a manner that said rotary blade holding case is resiliently biased to said guide member, one side of the rotary blade holding case being provided with a rotary blade bearing portion;

a bearing member mountable on another side of the rotary blade holding case that opposes the one side of the rotary blade holding case;

a safety plate mountable coaxially with the rotary blade so as to cover the rotary blade, the safety plate being disc shaped and having two semi-circular plates, the radius of the two semi-circular plates being different, the radius of one semi-circular plate being larger than the radius of the rotary blade, the radius of the other semi-circular plate being smaller than the radius of the rotary blade; and a shaft fittable into the rotary blade bearing portion, the rotary blade and the safety plate being rotatably mountable on the shaft.

2. The paper cutter according to claim 1, wherein the safety plate is provided with a lever for rotating the safety plate.

3. A paper cutter for cutting paper, comprising:

a rotary blade;

a guide rail;

a slider slidable along the guide rail to enable the rotary blade to cut the paper, the slider including:

a guide member slidable along the guide rail;

a rotary blade holding case mountable on the guide member in such a manner that said rotary blade holding case is resiliently biased to said guide member, the rotary blade holding case being provided with rotary blade bearing portions on both sides of the rotary blade holding case;

a safety plate mountable coaxially with the rotary blade so as to cover the rotary blade, the safety plate being disc shaped and having two semi-circular plates, the radius of the two semi-circular plates being different, the radius of one semi-circular plate being larger than the radius of the rotary blade, the radius of the other semi-circular plate being smaller than the radius of the rotary blade; and a shaft fittable between both sides of the rotary blade holding case.

4. The paper cutter according to claim 3, wherein the safety plate is provided with a lever for rotating the safety plate.

* * * * *